US010655309B1

(12) United States Patent
Oliver

(10) Patent No.: US 10,655,309 B1
(45) Date of Patent: May 19, 2020

(54) ACCELERATED DRAIN APPARATUS AND METHOD FOR WALK-IN BATHTUB

(71) Applicant: Daniel Oliver, Linden, TN (US)

(72) Inventor: Daniel Oliver, Linden, TN (US)

( * ) Notice: Subject to any disclaimer, the term of this patent is extended or adjusted under 35 U.S.C. 154(b) by 0 days.

(21) Appl. No.: 15/389,776

(22) Filed: Dec. 23, 2016

Related U.S. Application Data

(60) Provisional application No. 62/272,455, filed on Dec. 29, 2015.

(51) Int. Cl.

| | |
|---|---|
| ***E03C 1/048*** | (2006.01) |
| ***A47K 3/00*** | (2006.01) |
| ***E03C 1/23*** | (2006.01) |
| ***A47K 3/022*** | (2006.01) |
| ***E03C 1/12*** | (2006.01) |

(52) U.S. Cl.
CPC ..... *E03C 1/048* (2013.01); *A47K 3/006* (2013.01); *A47K 3/022* (2013.01); *E03C 1/23* (2013.01); *E03C 2001/1206* (2013.01)

(58) Field of Classification Search
CPC ..... A47K 3/006
USPC ..... 4/555, 556, 541.1–541.6
See application file for complete search history.

(56) References Cited

U.S. PATENT DOCUMENTS

| | | | | |
|---|---|---|---|---|
| 210,334 A | | 11/1878 | Kinsman | |
| 1,805,560 A | | 5/1931 | Barta | |
| 3,863,275 A | | 2/1975 | Brendgord | |
| 4,716,605 A | | 1/1988 | Shepherd | |
| 5,123,123 A | | 6/1992 | Hart | |
| 5,351,345 A | * | 10/1994 | Sills | A47K 3/006 4/555 |
| 7,886,372 B2 | | 2/2011 | Jacobs | |
| 8,549,678 B2 | * | 10/2013 | Neidich | A47K 3/006 4/538 |
| 8,683,622 B2 | | 4/2014 | Ciechanowski | |

FOREIGN PATENT DOCUMENTS

JP 2002364933 A 12/2002

OTHER PUBLICATIONS

Safety Tubs LLC, Safety Tubs luxury 60" x 32" walk-in tub, www.safetytubs.com/acrylictubs/603237_options.php, Safety Tubs LLC, 902 West, North Carrier Parkway, Grand Prairie, TX 75050 (at least as early as Apr. 14, 2015).
Safety Tubs LLC, electrical circuit diagrams, 2009.
(Continued)

*Primary Examiner* — Christine J Skubinna
(74) *Attorney, Agent, or Firm* — Baker Donelson; Carl M. Davis II; Dorian B. Kennedy

(57) ABSTRACT

An accelerated drain apparatus for a walk-in bathtub, in which a pump communicates water to a valve selectively in a first position to circulate the water through nozzles into the bath water therein and in a second position to a drain, with a controller configured for moving the valve selectively between the first and second positions, and during draining, stopping the pump in response to a signal from a water level sensor and after a predetermined period of gravity draining of residual water, moving the valve to the first position for subsequent filling and use of the walk-in bathtub.

15 Claims, 3 Drawing Sheets

(56) References Cited

OTHER PUBLICATIONS

Safety Tubs LLC, Walk-In Bath Installation Instructions and Owner's Manual, pp. 16, 20, and 24, Safety Tubs LLC, 902 West, North Carrier Parkway, Grand Prairie, TX 75050 (at least as early as Apr. 14, 2015).
Saftey Tubs LLC, Minute Drain, Safety Tubs LLC, 902 West, North Carrier Parkway, Grand Prairie, TX 75050 (at least as early as Apr. 14, 2015).
American Standard, Speed Connect® Drain, www.americanstandard-us.com/learn/american-standard-advantage/innovations/speed-connect, (at least as early as Apr. 14, 2015).
American Standard, Drain Overflow Installation, Quick Drain, www.americanstandard-us.com, American Standard (at least as early as Apr. 14, 2015).

* cited by examiner

ACCELERATED DRAIN APPARATUS AND METHOD FOR WALK-IN BATHTUB

TECHNICAL FIELD

The present invention relates to apparatus and methods for draining water from walk-in bathtubs. More particularly, the present invention relates to methods and apparatus selectively configured for circulating water within, and for draining water from, walk-in bathtubs.

BACKGROUND OF THE INVENTION

Walk-in bathtubs have in recent years become a popular addition for remodeling of bathrooms, or for installation in new construction as an added feature for bathrooms. Changing demographics, as well as personal choices for bathing, are making walk-in bathtubs a desired bathroom feature. Walk-in bathtubs typically have a closable door in a wall of the bathtub for entrance and egress by a bather. The sidewall defines a low threshold for the door, typically about 3 to 5 inches, for a bather to step over while entering or egressing the bathtub. In contrast, conventional bathtubs may have sidewalls of 18 inches, or more, over which a bather must pass for using the bathtub. Bathers who lack agility may find that stepping over the higher wall is difficult and a bather may slip or fall and may become seriously injured.

Walk-in bathtubs feature a door and low threshold for passage of the bather, with a seal that restricts passage of water between the door and its frame in the side wall of the bathtub when filled with water from a supply. Walk-in bathtubs also differ from conventional bathtubs by providing a greater depth for the water cavity defined by the walls of the bathtub. This greater depth for walk-in bathtubs is typically accomplished with side walls having a greater height than conventional bathtubs and/or by a narrower width and/or length. Walk-in bathtubs also typically include a seat for a bather to sit while bathing.

While walk-in bathtubs enable persons to relaxingly bath with easier entrance and egress through a door, there are drawbacks to walk-in bathtub devices. For example, upon completion of bathing, the bather must continue to occupy the bathtub during the time that water drains from the cavity to a sanitary sewer. The water level must reach at least the threshold, in order for the door to be opened and permit egress of the bather. Gravity flow of water from a bathtub is slow, and typical walk-in bathtubs may take 6 to 8 minutes, or more, to drain sufficiently for opening the door for egress.

Accordingly, there is a need in the art for an improved apparatus selectively configured for circulating water within, and for draining water from, walk-in bathtubs. It is to such that the present invention is directed.

BRIEF SUMMARY OF THE INVENTION

The present invention meets the need in the art for an improvement in draining of water from a walk-in bathtub. More particularly, the present invention provides a water flow control system for walk-in bathtubs, comprising a pump for receiving a supply of water through an inlet mounted in a wall of a walk-in bathtub that defines a cavity for holding the water. A valve for receiving water from the pump is selectively positioned in a first position and in a second position, the first position for communicating water to a manifold that communicates with a plurality of nozzles open to the cavity for circulating water within the walk-in bathtub and the second position for communicating water to a drain from the walk-in bathtub. A controller is configured for moving the valve selectively between the first position and the second position. A water level sensor mounted proximate a first edge of the inlet communicates a signal to the controller representative of sensing water, and the controller stops operation of the pump upon detecting a low water level. The pump being operated with the valve in the second position for draining water from the cavity, stops operating in response to the signal.

In another aspect, the present invention provides a method of accelerating drainage of water held in a cavity of a walk-in bathtub, comprising the steps of: (a) moving a valve from a first position to a second position to open communication with a drain conduit;

(b) pumping water held in a cavity of a walk-in bathtub through the drain conduit to a drain;

(c) sensing that a level of the water in the cavity has reached a predetermined lower limit;

(d) stopping the pump;

(e) gravity draining residual water from the cavity; and (f) moving the valve from the second position to the first position to close communication with the drain conduit after a predetermined period.

Objects, advantages, and features of the present invention will become readily apparent upon a reading of the following detailed description in conjunction with the drawings and the appended claims.

DETAILED DESCRIPTION

Figure 1:
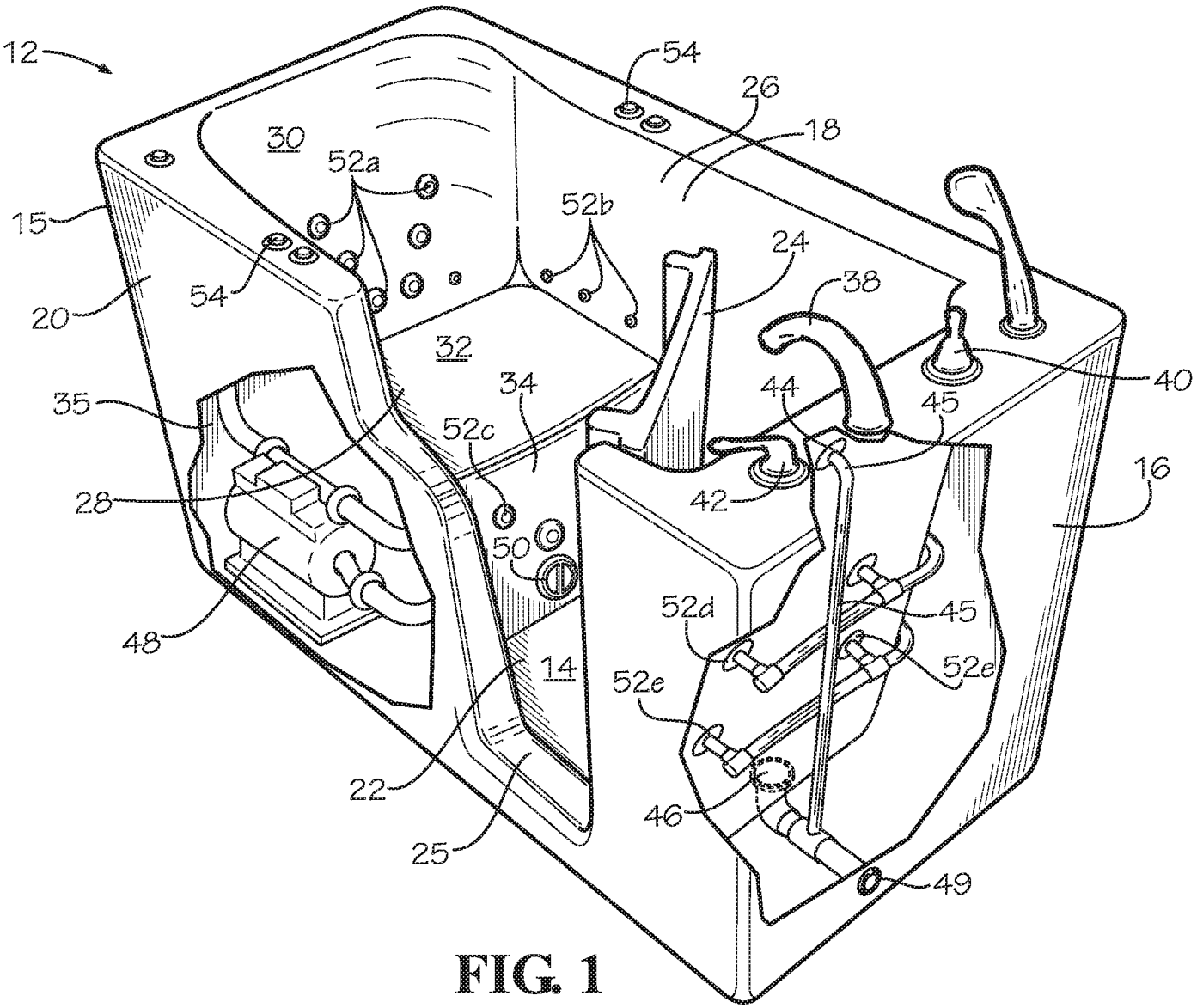
FIG. 1 illustrates in perspective cut-away view a walk-in bathtub.
Figure 2:
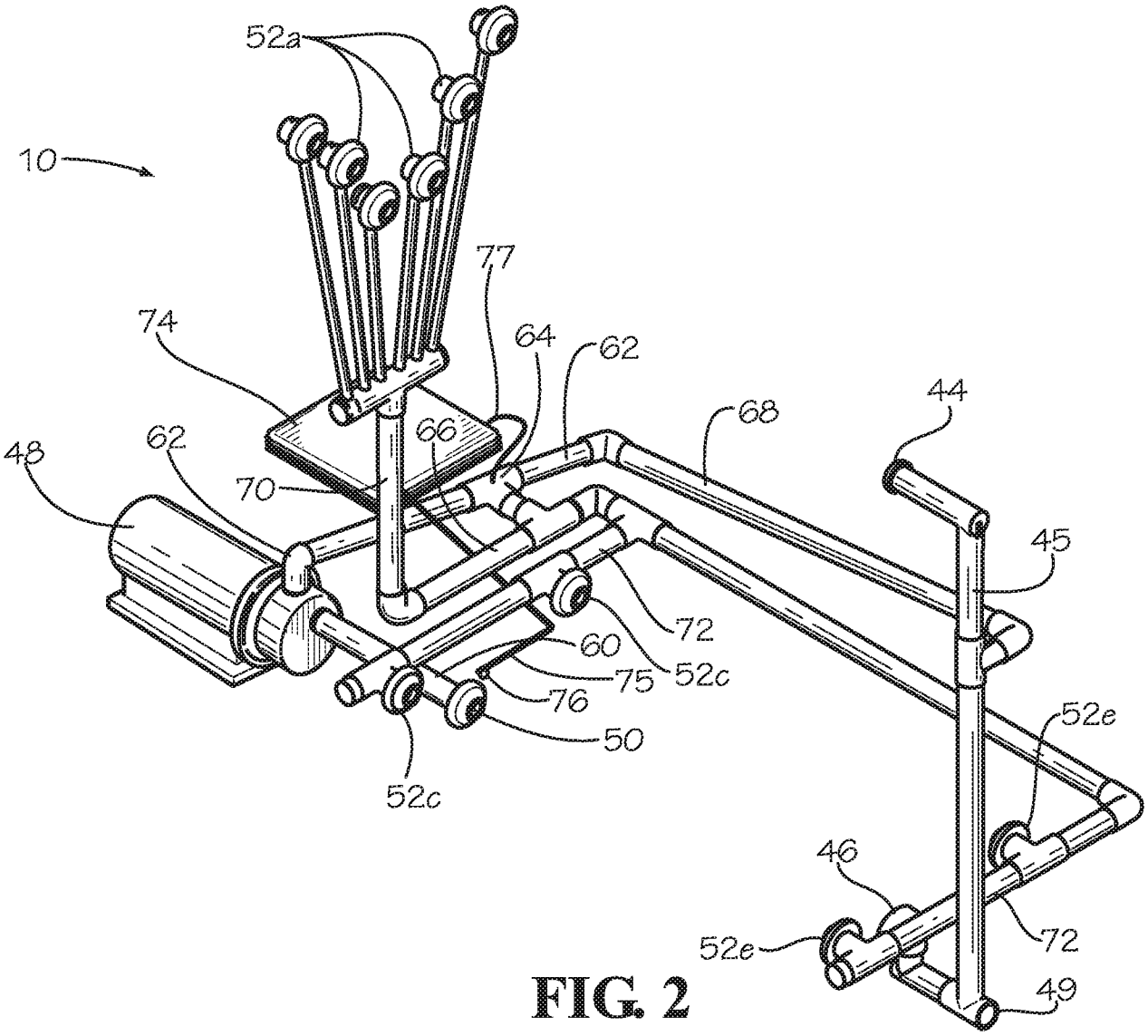
FIG. 2 illustrates in perspective view an apparatus selectively configured for circulating water within, and for draining water from, a walk-in bathtub.

With reference to the drawings, in which like parts have like identifiers, FIG. 2 illustrates in perspective view a drain apparatus 10 configured in accordance with the present invention for circulating water within, and for draining water from, a walk-in bathtub 12 such as that illustrated in perspective partially cut-away view in FIG. 1. The walk-in bathtub 12 includes a floor 14, opposing end walls 15, 16, a back wall 18, and a front wall 20 that defines a passage 22 closed by a door 24 (illustrated in an open position). The passage 22 is defined by threshold 25. The door 24 selectively moves between the open position and a closed position. In the open position, a bather may enter and exit through the passageway 22. With the door 24 in the closed position, the bathtub 12 defines a cavity 26 for receiving and holding water for the bather. The bathtub 12 defines a seating area generally 28 with a back 30, a seat 32, and a foot well 34. The seating area 28 defines a compartment 35 in a lower portion of the bathtub 12 for holding jet water circulation equipment and piping. The illustrated embodiment includes a spout 38 that communicates through water supply valves 40, 42 for controlling the flow of hot and cold water into the cavity 26. An upper portion of the end wall 16 defines an overflow opening 44. A drain pipe 45 connects to the overflow opening and communicates through an outlet at a distal end that connects to a sanitary sewer line for draining water from the cavity 26. The floor 14 defines a main floor drain 46 in a lower portion. A connector pipe connects the main floor drain 46 through a tee-joint to the pipe 45 for communicating water from the cavity 26 to the drain. A pump 48 mounts in the compartment 35 below the seating area 28. The pump 48 connects to an intake 50 disposed in wall in a lower portion of the foot wall 34. An output of the pump 48 connects through one or more manifolds and conduits to a plurality of water nozzles or jets 52. The illustrated embodiment includes lumbar water jets 52*a*, body side jets 52*b*, back leg jets 52*c*, foot jets 52*d*, and front leg jets 52*e*. Control switches 54 operate to select the jets to which the pumped water communicates. Various configurations may be readily plumbed and configured with control switches as is conventional in the jetted bathtub field.

With reference to FIG. 2, the drain apparatus 10 includes the pump 48 that connects through an intake pipe 60 to the intake 50 that is open to the water cavity of the bathtub 12. An outlet pipe 62 of the pump 48 connects to a valve 64. The valve 64 operates to direct water flow from the pump 48 to a jets manifold 66 or to a drain conduit 68. The jets manifold 66 in the illustrated embodiment connects to a lumbar jets branch 70 and further to leg and foot jet branches generally 72. The lumbar jets branch 70 feeds a plurality of lumbar jets 52*a* mounted in the wall that defines the seat back 30. The drain conduit 68 connects to the pipe 45 intermediate the overflow opening 44 and the connection of the main floor drain 46. A controller 74 mounts in the compartment 35. A lower limit water sensor 76 mounts in a wall of the foot well proximate an upper extent of the suction intake 50. A wiring harness 75 connects the controller 74 to the sensor 76. Generally, the sensor 76 is disposed at a height proximate the height of the threshold 25. The sensor 76 signals the controller 74 as to the lower water level in the cavity 26. In the illustrated embodiment, the controller 74 also connects with a control wiring harness 77 to the valve 64. The controller 74 provides operation signals to the valve 64 to move the valve selectively from a first position to a second position. In the first position, the valve 64 is open for circulating water from the intake 50, through the pump 48, and to the jets manifold 66 for jetting communication of circulating water through respective ones of the jets 52. In the second position, the valve 64 is open for draining water from the cavity 26 by communicating water from the intake 50, through the pump 48, and through the drain conduit 68 to the drain pipe 45 and to the drain 49. The drain 49 couples to a sanitary sewer such as through a conventional j-trap.

Figure 3:
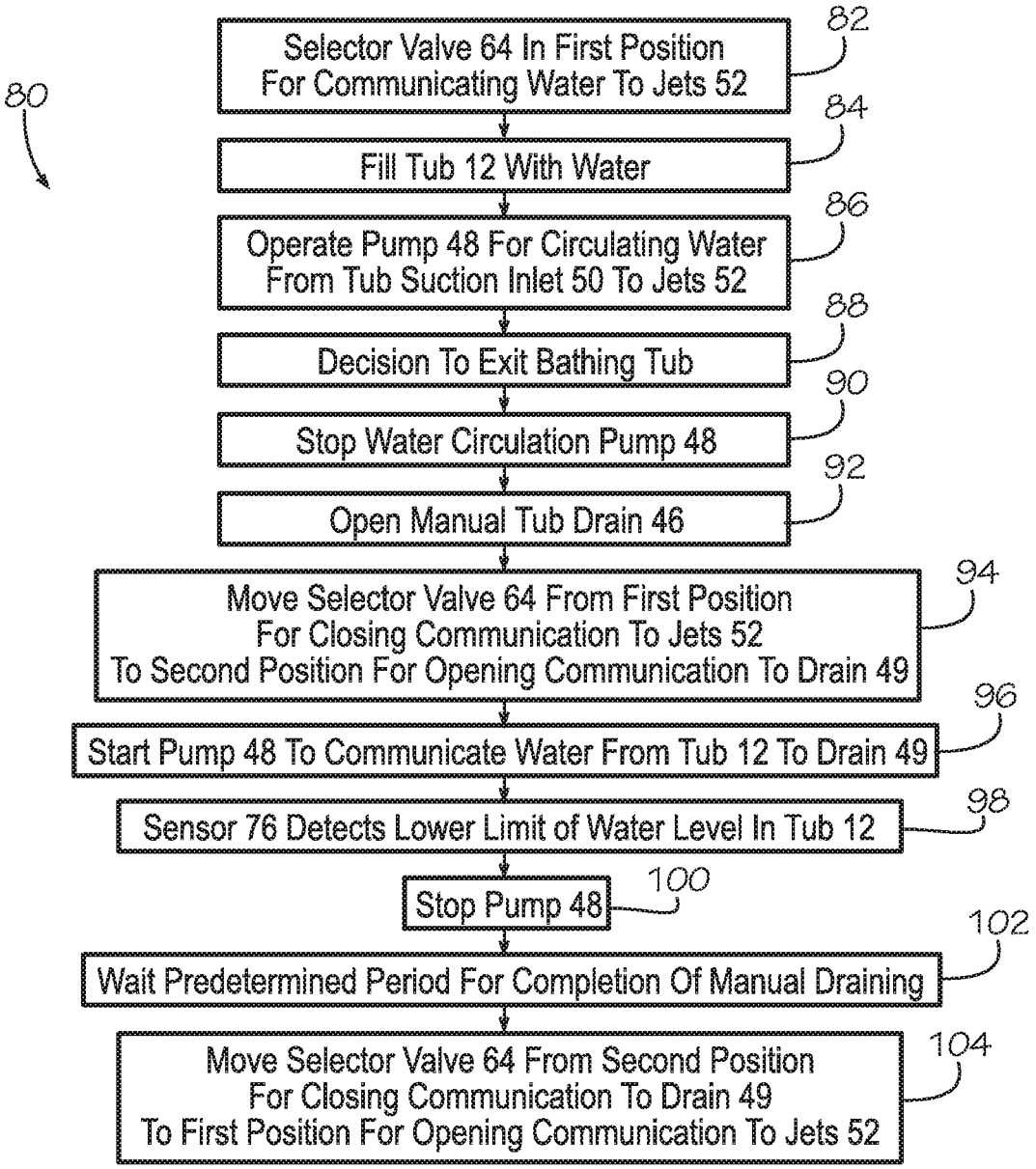
FIG. 3 illustrates a process flow for the apparatus illustrated in FIG. 2 for circulating water within, and for draining water from, a walk-in bathtub.

FIG. 3 illustrates a process flow 80 for the bathtub draining apparatus 10 illustrated in FIG. 2 for circulating water within, and for draining water from, the walk-in bathtub 12. The process flow 80 commences with an empty bathtub cavity 26. The bather opens the door 24 to enter the bathtub 12. The bather closes and secures the door 12 such as with a locking door handle to prevent inadvertent opening during use of the bathtub. The valve 64 is in the first position 82. The bather attends to filling 84 the bathtub cavity 26 with water using the water supply valves 40, 42. The water flows through the spout 38 into the cavity 26. Once a predetermined water depth is reached, the bather may operate 86 the pump 48 for circulating water within the bathtub. The controller 74 monitors the lower limit water sensor 76 and restricts pump operation if the water level is below the sensor. This prevents potential cavitation of the pump receiving air through the intake 50.

After appropriate bathing, the bather determines 88 to finish and depart the bathtub 12. This is accomplished by first draining the bathtub cavity 26 to at least a level below the threshold 25. The bather stops 90 the pump 48 to stop water circulating within the bathtub 12 through the jets 52. The bather opens 92 the main floor drain 46. Water begins gravity draining from the cavity 26 through the drain to the sanitary sewer. To assist emptying the cavity of water, the bather selectively activates the power drain feature. The bather operates 94 a drain switch to signal the controller 74 to commence power draining. The controller 74 first signals the valve 64 to move from the first position to the second position. This closes the circulation path from the pump 48 to the jets 52 and opens the drain conduit 68 to the pressure side of the pump. The pump 48 operates 96 to receive water through the intake 50 and communicate the water through the valve 64 and the drain conduit 68 to the drain pipe 45. Water in the cavity 26 thereby drains (1) by gravity through the main floor 46 and (2) by the pump with water flowing through the intake 50, the valve 64 and drain conduit 68, into the drain pipe for discharge into the sanitary sewer system.

The controller 74 continues to receive signals from the lower limit water sensor 76. The signal from the sensor 76 changes when the water level drops below the sensor. This indicates the water level has dropped to proximate an upper edge of the intake opening 50. Upon detecting 98 the change in the signal from the sensor 76, the controller 74 stops 100 the pump 48. This prevents cavitation. The water however continues to drain from the cavity 26 by gravity through the main floor drain 46. The bather may open the door 24 and exit the bathtub 12 because the water in the lower portion of the cavity 26 is below the threshold 25. The water in the drain conduit 68 flows back through the pump 48 and the intake 50 into a lower portion of the cavity 26. A predetermined period 102 provides for complete draining of the water from the cavity 26. Upon expiration of the period, the controller 74 signals the valve 64 to operate. The controller 74 causes 104 the valve 64 to move 100 from the second position to the first position. This positions the drain apparatus 10 closed for drainage and open for filing of the bathtub 12 and for communication of water within the cavity for circulating flow of water through the intake and the jets upon activation of the pump 48.

It is to be appreciated that the present invention facilitates prompt and accelerated drainage of water from the cavity 26, to reduce the amount of time a bather must wait before the door 24 may be opened for egress. In a configuration having a 1½ inch drain line, and a ¼ HP water pump, the drain apparatus 10 may reduce drain time by about 5-8 minutes, depending on the volume of water within the cavity 26. In a first embodiment, the drain apparatus 10 may be configured to leave the valve 64 in the second position for an extended period after the pump, being operated for draining water, is turned off. This assures that the water in the drain conduit 68 flows back through the pump 48 and through the main floor drain 46. Upon completion of the predetermined period, the controller moves the valve 64 to the first position. The controller thereby configures the bathtub 12 for the next use for filling and bathing with the valve 64 in the first position closing the drain conduit 68. For a typical configuration having a residual water volume of about 5-8 gallons in the lower portion of the foot well (below the threshold height), a predetermined period of about 1 to about 4 minutes is sufficient to allow the residual water to drain though the main floor drain 46.

In an alternate embodiment, the dwell period for the valve to remain in the second position is a predetermined period commencing when the pump starts in drain mode after the bather selectively activates the assisted draining apparatus. In such embodiment, a bathtub holding 120 gallons and a drain flow rate of 10 gallons per minute, the predetermined period of between about 8 minutes to about 12 minutes provides for power assisted draining to the lower limit sensor and gravity drain for residual water before the controller moves the valve 64 to the first position.

In an alternate embodiment, the walk-in bathtub is configured for the bather to manually configure the pump and drain apparatus. The bather stops the pump that circulates the bath water through the jet nozzles. The bather then opens the main floor drain 46 (such as using conventional fixture lift rod or rotatable plug received in a drain seat). The water begins gravity draining from the walk-in-bathtub. To advance the progress of draining, the bather moves the valve from the first circulation position to the second drain position. In this alternate embodiment, this is accomplished by the bather operating a switch that communicates with the controller. The controller, in response, causes the valve to move to the second position. The controller starts the pump to communicate bath water through the intake 50 and through the drain conduit 68 to discharge into the sanitary sewer. The low level water sensor signals the controller when the water level drops below the sensor (such as at or about the height of the threshold). The controller stops the pump and waits a predetermined period. During the dwell period, the water continues draining from the main floor drain 46 to the sanitary sewer. The period is sufficient for the residual water, including that in the drain conduit 68, to drain from the foot well of the bathtub 12. The controller than moves the valve 64 to the first position, to prepare the bathtub 12 for subsequent filling and use as a walk-in bathtub.

The present invention accordingly provides an apparatus and method for accelerating drainage of bath water from a walk-in bathtub. While this invention has been described in detail with particular references to illustrated embodiments thereof, it should be understood that many modifications, additions and deletions, in additions to those expressly recited, may be made thereto without departure from the spirit and scope of the invention recited in the appended claims.

What is claimed is:

1. A water flow control system for walk-in bathtubs, comprising:

a pump for receiving a supply of water through an inlet mounted in a wall of a walk-in bathtub that defines a cavity for holding the water;

a valve for receiving water from the pump and selectively positioned in a first position and in a second position, the first position for communicating water to a manifold that communicates with a plurality of nozzles open to the cavity for circulating water within the walk-in bathtub and the second position for communicating water to a drain from the walk-in bathtub;

a controller configured for moving the valve selectively between the first position and the second position; and a water level sensor mounted proximate a first edge of the inlet and communicating a signal to the controller representative of sensing water, the controller stopping operation of the pump upon detecting a low water level, whereby the pump being operated with the valve in the second position for draining water from the cavity, stops operating in response to the signal.

2. The water flow control system as recited in claim 1, wherein the valve is biased to be in the first position for filling the cavity with water.

3. The water flow control system as recited in claim 1, wherein the controller is configured to move the valve from the second position to the first position after a predetermined period.

4. The water flow control system as recited in claim 3, wherein the predetermined period commences upon initiation of operation of the pump after moving the valve from the first position to the second position.

5. The water flow control system as recited in claim 4, wherein the predetermined period is between about 8 minutes to about 12 minutes.

6. The water flow control system as recited in claim 1, wherein the controller, sensing a low water level, stops the pump from operating with the valve in the second position for draining water and waits a predetermined period before moving the valve from the second position to the first position.

7. The water flow control system as recited in claim 6, wherein the predetermined period is about 1 minute to about 4 minutes.

8. The water flow control system as recited in claim 1, wherein the controller is configured for selectively operating the pump unless stopped in response to a signal from the sensor.

9. The water flow control system as recited in claim 1, wherein the controller is configured with the valve in the first position for selectively operating the pump when a water level sensor senses water and with the valve in the second position for stopping operation of the pump upon sensing the low water signal.

10. The water flow control system as recited in claim 1, wherein the controller is configured for moving the valve from the second position to the first position after the predetermined period.

11. A water flow control system for walk-in bathtubs, comprising:

a pump for receiving a supply of water through an inlet in a wall of a walk-in bathtub that communicates with basin for holding the water;

a valve for receiving water from the pump and selectively positioned in a first position and in a second position, the first position for communicating the water to a manifold that communicates with a plurality of nozzles open to the basin for circulating water within the walk-in bathtub and the second position for communicating water to a drain for selectively discharging water from the basin of the walk-in bathtub;

a controller configured for moving the valve selectively between the first position and the second position and configured for moving the valve from the second position to the first position after a predetermined period commencing upon initiation of operation of the pump after moving the valve from the first position to the second position; and a water level sensor mounted proximate a first edge of the inlet and communicating a signal to the controller representative of sensing water, the controller stopping operation of the pump upon detecting a low water level, whereby the pump being operated with the valve in the second position for draining water from the cavity, stops operating in response to the signal while water discharges through the drain from the basin.

12. The water flow control system as recited in claim 11, wherein the predetermined period is between about 8 minutes to about 12 minutes.

13. The water flow control system as recited in claim 12, wherein the controller, sensing a low water level, stops the pump from operating with the valve in the second position for draining water and waits a second predetermined period before moving the valve from the second position to the first position.

14. The water flow control system as recited in claim 13, wherein the second predetermined period is about 1 minute to about 4 minutes.

15. The water flow control system as recited in claim 11, wherein the controller, sensing with a sensor a low water level, stops the pump from operating with the valve in the second position for draining water and waits a second predetermined period before moving the valve from the second position to the first position.

* * * * *